US011993347B2

(12) United States Patent
Fishburn et al.

(10) Patent No.: US 11,993,347 B2
(45) **Date of Patent: *May 28, 2024**

(54) MULTIPLE CHINE PONTOON BOAT

(71) Applicant: Polaris Industries Inc., Medina, MN (US)

(72) Inventors: Bradley Roy Fishburn, Nappanee, IN (US); Gabriel A. Marshall, Three Rivers, MI (US)

(73) Assignee: Polaris Industries Inc., Medina, MN (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/144,270

(22) Filed: May 8, 2023

(65) Prior Publication Data

US 2023/0271676 A1 Aug. 31, 2023

Related U.S. Application Data

(63) Continuation of application No. 17/228,283, filed on Apr. 12, 2021, now Pat. No. 11,661,148, which is a (Continued)

(51) Int. Cl.
*B63B 1/12* (2006.01)
*B63B 35/38* (2006.01)

(52) U.S. Cl.
CPC ..... *B63B 1/125* (2013.01); *B63B 35/38* (2013.01)

(58) Field of Classification Search
CPC ..... B63B 35/00; B63B 35/34; B63B 35/38; B63B 35/613; B63B 1/00; B63B 1/10; (Continued)

(56) References Cited

U.S. PATENT DOCUMENTS 31,563 A 2/1861 Seibert et al.
717,662 A 1/1903 Ellison
(Continued)

FOREIGN PATENT DOCUMENTS

FR 2387840 A1 11/1978
FR 2636295 A1 3/1990
(Continued)

OTHER PUBLICATIONS

JC TriToon Marine, The Original TriToon Brochure, dated Dec. 15, 2017; 32 pages.
(Continued)

*Primary Examiner* — Daniel V Venne
(74) *Attorney, Agent, or Firm* — Faegre Drinker Biddle & Reath LLP

(57) ABSTRACT

A pontoon boat is provided that includes a deck and a plurality of pontoons running longitudinally beneath the deck and providing buoyancy to the pontoon boat. The plurality of pontoons include a multi-chine configuration that increases the stability of the pontoon boat and provides handling characteristics similar to that of a hulled boat. The plurality of pontoons may include two outer pontoons and a third pontoon positioned laterally intermediate the outer pontoons. The third pontoon may include a plurality of chines, and each of the outer pontoons may include at least one chine. At least a portion of each of the at least one chines of the outer pontoons may be positioned vertically below the plurality of chines of the third pontoon. The chines on the third pontoon may extend longitudinally further than each of the at least one chines of the outer pontoons.

10 Claims, 9 Drawing Sheets

Related U.S. Application Data continuation of application No. 16/668,948, filed on Oct. 30, 2019, now Pat. No. 11,192,610.

(58) Field of Classification Search

CPC .. B63B 1/12; B63B 1/125; B63B 1/16; B63B 1/18; B63B 2001/183; B63B 2001/186; B63B 1/20; B63B 1/24; B63B 1/242; B63B 1/248; B63B 1/26

USPC ..... 114/61.1, 61.2, 61.22, 271, 274, 278, 114/283, 288, 290, 292

See application file for complete search history.

(56) References Cited

U.S. PATENT DOCUMENTS 731,515 A 6/1903 Sheen et al.
998,437 A 7/1911 Wieland
1,202,713 A 10/1916 Hedges
1,448,921 A 3/1923 Ershkowitz
1,646,266 A 10/1927 Stoner
2,233,254 A 2/1941 Elling
2,249,958 A 7/1941 Inwood
2,448,075 A 8/1948 Bortner
2,491,609 A 12/1949 George
2,821,989 A 2/1958 Shepard
2,910,033 A 10/1959 Weisburg
2,919,669 A 1/1960 Kikuhara
2,950,699 A 8/1960 Frank et al.
2,959,146 A 11/1960 Erkert
2,990,802 A 7/1961 Eric et al.
3,002,484 A 10/1961 Dube
3,065,724 A 11/1962 Tritt
3,067,711 A 12/1962 Hesher et al.
3,103,947 A 9/1963 Mueller
3,115,860 A 12/1963 Payne
3,130,852 A 4/1964 Klugh
3,230,918 A 1/1966 Compton
3,352,447 A 11/1967 Hahn
3,361,227 A 1/1968 Kauko
3,363,598 A 1/1968 Mortrude
3,369,518 A 2/1968 Jacobson
3,401,663 A 9/1968 Yost
3,405,677 A 10/1968 Smith
3,456,613 A 7/1969 Smith
3,481,297 A 12/1969 Mantle
3,485,198 A 12/1969 Matthews
3,548,773 A 12/1970 Laughlin
3,614,937 A 10/1971 Schulman
3,648,641 A 3/1972 Normand, Jr.
3,685,061 A 8/1972 Wray
3,695,210 A 10/1972 Stein
3,702,106 A 11/1972 Wilder
3,707,936 A 1/1973 Harris
3,782,320 A 1/1974 Groves
3,829,153 A 8/1974 Fussell et al.
3,908,797 A 9/1975 Schnepp
3,937,173 A 2/1976 Stuart
3,981,721 A 9/1976 Takashima
3,996,871 A 12/1976 Boismard
4,005,674 A 2/1977 Davis
4,019,456 A 4/1977 Harbert
4,051,801 A 10/1977 Woodfill et al.
4,056,211 A 11/1977 Zumwalt
4,084,533 A 4/1978 Boyer
4,084,536 A 4/1978 Stansbury
4,100,877 A 7/1978 Scott et al.
4,223,630 A 9/1980 Keeney
4,247,232 A 1/1981 Mccreery et al.
4,311,317 A 1/1982 Bartels
D263,293 S 3/1982 Janson
4,320,713 A 3/1982 Nishida et al.
4,348,972 A 9/1982 Parsons
4,385,580 A 5/1983 Davidson
4,404,714 A 9/1983 Duran
4,413,215 A 11/1983 Cavil et al.
4,420,741 A 12/1983 West
4,448,430 A 5/1984 Bright
4,509,927 A 4/1985 Ikeda
4,568,293 A 2/1986 Yazaki
4,588,220 A 5/1986 Matsui et al.
4,609,360 A 9/1986 Whitehead
4,616,168 A 10/1986 Nishida
4,629,434 A 12/1986 Monreal
4,643,685 A 2/1987 Nishida
4,678,444 A 7/1987 Monreal
4,688,508 A 8/1987 Nishida
4,690,094 A 9/1987 Taylor
4,706,702 A 11/1987 Grasseschi
4,709,648 A 12/1987 Andrews
4,744,325 A 5/1988 Nobayashi
4,756,332 A 7/1988 Grasseschi
4,760,810 A 8/1988 Kobayashi
4,762,078 A 8/1988 Palmer, Jr.
4,799,444 A 1/1989 Lisowski
4,824,409 A 4/1989 Kobayashi
4,840,592 A 6/1989 Anderson
4,870,843 A 10/1989 Lundberg
4,870,919 A 10/1989 Allison
4,875,882 A 10/1989 Plitt et al.
4,875,884 A 10/1989 Meisenburg
4,896,621 A 1/1990 Coles
4,907,520 A 3/1990 Pipkorn
4,917,037 A 4/1990 Hargett, Sr.
4,924,798 A 5/1990 Lathers
4,926,783 A 5/1990 Lathers
4,932,347 A 6/1990 Mardikian
4,941,854 A 7/1990 Takahashi et al.
4,942,837 A 7/1990 Hellmann et al.
4,942,838 A 7/1990 Boyer et al.
4,947,781 A 8/1990 Norman
4,964,357 A 10/1990 Genfan
RE33,488 E 12/1990 Kobayashi
4,982,682 A 1/1991 Hattori
4,986,777 A 1/1991 Preston
4,989,409 A 2/1991 Nakase et al.
4,997,399 A 3/1991 Nakayasu et al.
4,998,966 A 3/1991 Yamaguchi
5,005,963 A 4/1991 Schmidt et al.
5,007,870 A 4/1991 Okubo et al.
5,036,789 A 8/1991 Kelly et al.
5,037,687 A 8/1991 Kargarzadeh et al.
5,043,727 A 8/1991 Ito
5,049,096 A 9/1991 Henn
5,062,815 A 11/1991 Kobayashi
5,064,157 A 11/1991 O'Neal
5,067,448 A 11/1991 Nakase et al.
5,067,918 A 11/1991 Kobayashi
5,076,188 A 12/1991 Burroughs
5,086,725 A 2/1992 Garrett et al.
5,096,208 A 3/1992 Westberg
5,096,753 A 3/1992 Mccue et al.
5,097,789 A 3/1992 Oka
5,101,753 A 4/1992 Hull et al.
5,135,239 A 8/1992 Kato et al.
5,141,456 A 8/1992 Langenberg et al.
5,149,569 A 9/1992 Mccue
5,151,057 A 9/1992 Kobayashi et al.
5,154,650 A 10/1992 Nakase
5,184,561 A 2/1993 Nickell, Jr.
5,184,564 A 2/1993 Robbins et al.
5,199,373 A 4/1993 Mardikian
5,199,913 A 4/1993 Toyohara et al.
5,216,421 A 6/1993 Sawada et al.
5,234,364 A 8/1993 Ito
5,239,884 A 8/1993 Norsen
5,255,626 A 10/1993 Hattori et al.
5,256,092 A 10/1993 Jones
5,259,331 A 11/1993 Hagan
D343,160 S 1/1994 LaPointe
5,289,997 A 3/1994 Harris
5,296,973 A 3/1994 Burke
5,303,667 A 4/1994 Zirkelbach et al.
5,304,078 A 4/1994 Kaneko
5,312,275 A 5/1994 Place

(56) References Cited

U.S. PATENT DOCUMENTS 5,315,895 A 5/1994 Kattus et al.
5,329,871 A 7/1994 Gibbs
D349,879 S 8/1994 Jaramillo, Sr.
D350,325 S 9/1994 Mardikian
5,350,325 A 9/1994 Nanami
5,355,826 A 10/1994 Hattori et al.
5,366,401 A 11/1994 Nanami et al.
5,367,977 A 11/1994 Ellis et al.
5,389,022 A 2/1995 Kobayashi
5,390,621 A 2/1995 Hattori et al.
5,399,111 A 3/1995 Kobayashi et al.
5,405,278 A 4/1995 Garland
5,413,063 A 5/1995 King
D359,469 S 6/1995 Yoshida et al.
D359,720 S 6/1995 Jaramillo, Sr.
5,438,946 A 8/1995 Kobayashi
5,447,116 A 9/1995 Kobayashi
5,449,305 A 9/1995 Kobayashi et al.
5,458,079 A 10/1995 Matthews et al.
5,462,292 A 10/1995 Yamane
5,464,301 A 11/1995 Kramer
5,474,007 A 12/1995 Kobayashi
5,490,474 A 2/1996 Ikeda
5,494,464 A 2/1996 Kobayashi et al.
5,503,419 A 4/1996 Gardner
5,507,672 A 4/1996 Imaeda
5,511,505 A 4/1996 Kobayashi et al.
5,520,139 A 5/1996 King et al.
5,524,597 A 6/1996 Hiki et al.
5,536,189 A 7/1996 Mineo
5,540,174 A 7/1996 Kishi et al.
5,544,607 A 8/1996 Rorabaugh et al.
5,551,898 A 9/1996 Matsumoto
5,556,314 A 9/1996 Fukuda et al.
5,572,943 A 11/1996 Kobayashi et al.
5,575,231 A 11/1996 Metcalf
5,588,388 A 12/1996 Maruyama et al.
5,593,329 A 1/1997 Kato
5,603,644 A 2/1997 Kobayashi et al.
5,607,332 A 3/1997 Kobayashi et al.
5,613,459 A 3/1997 Remy
5,613,887 A 3/1997 Kobayashi
D380,437 S 7/1997 Saulters
5,655,473 A 8/1997 Arvilla
5,664,515 A 9/1997 Hattori et al.
5,669,326 A 9/1997 Ikeda
5,676,575 A 10/1997 Fukuda et al.
5,678,827 A 10/1997 Burian et al.
5,697,320 A 12/1997 Murray
5,699,750 A 12/1997 Schneider
5,706,752 A 1/1998 Menne et al.
5,707,264 A 1/1998 Kobayashi et al.
5,713,297 A 2/1998 Tani et al.
5,730,077 A 3/1998 Nunes et al.
5,735,229 A 4/1998 House et al.
5,743,204 A 4/1998 Tweet
5,743,206 A 4/1998 Hattori
5,752,864 A 5/1998 Jones et al.
5,752,867 A 5/1998 Koyanagi
5,755,601 A 5/1998 Jones
5,799,605 A 9/1998 Huse
5,803,104 A 9/1998 Pollen
D399,182 S 10/1998 Lapointe
5,826,532 A 10/1998 Elvestad
5,829,378 A 11/1998 Nunes et al.
5,868,455 A 2/1999 Springer et al.
5,882,796 A 3/1999 Wilson et al.
5,894,810 A 4/1999 Orr
5,899,779 A 5/1999 Hattori
5,904,114 A 5/1999 Wright
5,908,006 A 6/1999 Ibata
5,911,187 A * 6/1999 Sohm ..... B63B 1/12 114/283
5,913,571 A 6/1999 Dystra et al.
5,915,329 A 6/1999 Watkins et al.
5,918,564 A 7/1999 Ohtsuka et al.
5,931,114 A 8/1999 Bartholomew
5,934,953 A 8/1999 Kobayashi
5,934,954 A 8/1999 Schott et al.
5,964,172 A 10/1999 Ikeda
5,988,087 A 11/1999 Pepper
6,000,355 A 12/1999 Hall
6,006,692 A 12/1999 Szukhent, Jr.
6,010,140 A 1/2000 Guynn
6,010,378 A 1/2000 Fujimoto et al.
6,016,762 A 1/2000 Price
6,022,253 A 2/2000 Ozawa et al.
6,032,605 A 3/2000 Takashima
6,035,802 A 3/2000 Lussier
6,041,727 A 3/2000 Yamada et al.
6,050,867 A 4/2000 Shields et al.
6,066,014 A 5/2000 Smith et al.
6,085,685 A 7/2000 Morishige
6,089,932 A 7/2000 Nanami et al.
6,095,876 A 8/2000 Ozawa et al.
6,105,527 A 8/2000 Lochtefeld et al.
6,112,685 A 9/2000 Matsuda et al.
6,115,860 A 9/2000 Vrzalik
6,116,182 A 9/2000 Koyanagi
6,135,832 A 10/2000 Suzuki
6,139,381 A 10/2000 Suzuki et al.
6,145,458 A 11/2000 Hattori
6,152,587 A 11/2000 Berg
6,158,378 A 12/2000 Tsumiyama et al.
6,182,590 B1 2/2001 Patera
6,224,440 B1 5/2001 Shimizu
6,237,522 B1 5/2001 Kiyohara et al.
6,250,983 B1 6/2001 Paterson
D444,761 S 7/2001 Momoi et al.
6,260,505 B1 7/2001 Polidan
6,276,290 B1 8/2001 Yamada et al.
6,308,650 B1 10/2001 Tsumiyama et al.
6,322,409 B1 11/2001 Hattori et al.
6,345,585 B1 2/2002 Hovda et al.
6,349,662 B1 2/2002 Limansky et al.
6,349,666 B1 2/2002 Hastings
6,375,527 B2 4/2002 Gohara
6,379,204 B2 4/2002 Bolen
6,419,533 B2 7/2002 Lecours
6,435,924 B2 8/2002 Ishino
D462,644 S 9/2002 Aselton et al.
D463,355 S 9/2002 Bucaccio et al.
D463,770 S 10/2002 Aselton et al.
D464,015 S 10/2002 Bucaccio et al.
D464,016 S 10/2002 Orr et al.
6,457,433 B1 10/2002 Nagata
6,470,817 B2 10/2002 Delfosse
6,471,557 B1 10/2002 Hattori
6,471,558 B1 10/2002 Nakatsuji et al.
D465,191 S 11/2002 Bucaccio et al.
D465,192 S 11/2002 Bucaccio et al.
6,491,557 B2 12/2002 Tamaki
6,506,086 B2 1/2003 Matsumoto
6,523,490 B1 2/2003 Watkins
6,546,884 B1 4/2003 Rodriguez
6,546,888 B2 4/2003 Bertrand et al.
6,547,611 B1 4/2003 Boroos et al.
6,553,928 B2 4/2003 Yamada et al.
6,578,508 B2 6/2003 Hattori et al.
D476,612 S 7/2003 Bills et al.
D476,613 S 7/2003 Bills et al.
D477,560 S 7/2003 Bills et al.
D478,034 S 8/2003 Bills et al.
D478,035 S 8/2003 Bills et al.
D482,316 S 11/2003 Bills et al.
6,647,916 B2 11/2003 Neese et al.
6,651,579 B1 11/2003 Wynne et al.
D485,799 S 1/2004 Nugteren et al.
6,672,241 B2 1/2004 Warfel et al.
6,675,736 B1 1/2004 Schreiber et al.
6,681,712 B1 1/2004 Andreae et al.
D487,246 S 3/2004 Bills et al.
D487,718 S 3/2004 Bills et al.
D487,883 S 3/2004 Bills et al.

(56) References Cited

U.S. PATENT DOCUMENTS

| | | | | |
|---|---|---|---|---|
| 6,712,016 | B1 | 3/2004 | Morisch et al. | |
| D488,117 | S | 4/2004 | Bills et al. | |
| 6,722,301 | B2 | 4/2004 | Nagata et al. | |
| 6,739,921 | B2 | 5/2004 | Nakajima et al. | |
| 6,755,704 | B1 | 6/2004 | Leinonen | |
| 6,755,705 | B1 | 6/2004 | Slattery | |
| 6,789,494 | B2 | 9/2004 | Neese et al. | |
| 6,807,920 | B1 | 10/2004 | Wynne | |
| 6,807,922 | B1 | 10/2004 | Bills et al. | |
| 6,808,433 | B1 | 10/2004 | Slattery et al. | |
| 6,820,569 | B2 | 11/2004 | Warfel et al. | |
| 6,843,192 | B1 | 1/2005 | Nugteren et al. | |
| 6,863,013 | B2 | 3/2005 | Noyes, Jr. | |
| 6,863,582 | B1 | 3/2005 | Wynne | |
| 6,880,475 | B1 | 4/2005 | Thompson | |
| 6,932,012 | B1 | 8/2005 | Philips et al. | |
| 6,959,660 | B1 | 11/2005 | Packebush | |
| 6,988,456 | B1 | 1/2006 | Schooler | |
| 7,051,669 | B2 | 5/2006 | Warfel et al. | |
| 7,107,926 | B2 | 9/2006 | Fishburn | |
| 7,121,218 | B2 | 10/2006 | Stinson et al. | |
| 7,137,351 | B2 | 11/2006 | Picou | |
| 7,240,632 | B1 | 7/2007 | Wynne et al. | |
| 7,255,403 | B2 | 8/2007 | Butler | |
| 7,267,590 | B1 | 9/2007 | Jones et al. | |
| 7,367,616 | B2 | 5/2008 | Summerford | |
| 7,430,980 | B2 | 10/2008 | Fishburn | |
| 7,490,896 | B2 | 2/2009 | Smith | |
| 7,513,211 | B1 | 4/2009 | Farb et al. | |
| 7,703,408 | B2 | 4/2010 | Payne | |
| 7,832,348 | B2 | 11/2010 | Newcomb | |
| 7,870,830 | B2 | 1/2011 | Bogard et al. | |
| 7,950,340 | B1 | 5/2011 | Curtis | |
| 8,028,641 | B1 | 10/2011 | Sly | |
| 8,113,137 | B2 | 2/2012 | Thompson | |
| 8,156,885 | B1 | 4/2012 | Beach | |
| 8,186,291 | B1 * | 5/2012 | Curtis | B63B 1/20 114/61.1 |
| 8,474,393 | B1 | 7/2013 | Chandler | |
| 9,415,836 | B1 | 8/2016 | Eekhoff et al. | |
| D770,965 | S | 11/2016 | Deurr et al. | |
| D772,136 | S | 11/2016 | Deurr et al. | |
| D772,776 | S | 11/2016 | Deurr et al. | |
| 9,487,273 | B1 | 11/2016 | Eekhoff et al. | |
| D780,087 | S | 2/2017 | Deurr et al. | |
| D784,902 | S | 4/2017 | Deurr et al. | |
| 9,873,487 | B1 | 1/2018 | Eekhoff et al. | |
| 9,937,983 | B1 | 4/2018 | Duke et al. | |
| 9,981,721 | B2 | 5/2018 | Deurr et al. | |
| 10,486,772 | B1 | 11/2019 | Sohm | |
| 10,494,074 | B1 | 12/2019 | Duquette et al. | |
| 10,589,823 | B1 | 3/2020 | Fenech et al. | |
| 10,940,918 | B2 * | 3/2021 | Sohm | B64C 25/54 |
| 10,953,955 | B1 * | 3/2021 | Fieldhouse | B63B 1/32 |
| 11,155,321 | B2 * | 10/2021 | Minor | B63B 1/30 |
| 11,420,715 | B1 | 8/2022 | Simard et al. | |
| 11,459,064 | B1 | 10/2022 | Simard et al. | |
| 2001/0000052 | A1 | 3/2001 | Yamada et al. | |
| 2001/0047744 | A1 | 12/2001 | Aselton et al. | |
| 2002/0023579 | A1 | 2/2002 | Profitt et al. | |
| 2002/0053310 | A1 | 5/2002 | Ibata et al. | |
| 2002/0077007 | A1 | 6/2002 | Dagenais et al. | |
| 2002/0182949 | A1 | 12/2002 | Tanaka et al. | |
| 2003/0061975 | A1 | 4/2003 | Nadeau et al. | |
| 2004/0048527 | A1 | 3/2004 | Yokoya | |
| 2004/0058597 | A1 | 3/2004 | Matsuda | |
| 2005/0098077 | A1 | 5/2005 | Blaisdell et al. | |
| 2006/0061154 | A1 | 3/2006 | Kahan | |
| 2009/0031939 | A1 | 2/2009 | Fishburn | |
| 2010/0018451 | A1 | 1/2010 | Sahr | |
| 2014/0048008 | A1 | 2/2014 | Kalil | |
| 2018/0154986 | A1 | 6/2018 | Vogel et al. | |
| 2021/0129944 | A1 | 5/2021 | Fishburn et al. | |
| 2021/0229777 | A1 | 7/2021 | Fishburn et al. | |

FOREIGN PATENT DOCUMENTS

| | | | |
|---|---|---|---|
| FR | 2806696 | A1 | 9/2001 |
| JP | 55-127273 | A | 10/1980 |
| JP | 62-247994 | A | 10/1987 |
| JP | 08-031648 | A | 2/1996 |
| JP | 2000-038195 | A | 2/2000 |
| JP | 2001-287693 | A | 10/2001 |
| JP | 2002-337786 | A | 11/2002 |
| WO | 2007/045934 | A1 | 4/2007 |

OTHER PUBLICATIONS

Office Action issued by the Canadian Intellectual Property Office, dated Jun. 18, 2020, for Canadian Patent Application No. 2,987,528; 4 pages.

World Champion Watercraft components. Product sheet [online]. River Pot Design, 2001, [retrieved on Jul. 2, 2003]. Retrieved from the Internet: <URL:web.archive.org/web/20010926015150/http://www.rpotdesign.com/.

* cited by examiner

MULTIPLE CHINE PONTOON BOAT

RELATED APPLICATION

This application is a continuation of U.S. patent application Ser. No. 17/228,283, filed Apr. 12, 2021, titled Multiple Chine Pontoon Boat which is a continuation of U.S. patent application Ser. No. 16/668,948, filed Oct. 30, 2019, now U.S. Pat. No. 11,192,610, titled Multiple Chine Pontoon Boat, the entire disclosures of which are expressly incorporated by reference.

FIELD

The present disclosure relates to the structure of a pontoon boat and, in particular, to pontoon boat having a multi-chine configuration.

BACKGROUND

Boating has become an increasingly popular form of recreation, leisure and platform for water sports. One type of boat, namely, pontoon boats, which have two or more longitudinally extending floatation devices with buoyancy sufficient to float itself and the deck, seats, and other boat equipment supported thereon, have also seen a rise in popularity. Pontoon boats provide an economical way to provide a large deck area accommodating many passengers as well as a smooth ride. It is also desirable to have a pontoon boat handle in a manner similar to a hulled boat.

SUMMARY OF THE DISCLOSURE

In an exemplary embodiment of the present disclosure, a pontoon boat is disclosed. The pontoon boat comprises a plurality of longitudinally extending pontoons, a deck supported atop the plurality of pontoons, and a plurality of foils coupled to the plurality of pontoons. The plurality of pontoons including a first pontoon, a second pontoon, and a third pontoon. The second pontoon is positioned intermediate the first and third pontoons. The plurality of foils includes a first foil coupled to the first pontoon and a second foil coupled to the second pontoon. At least a portion of the first foil is positioned vertically below an entirety of the second foil.

In another exemplary embodiment of the present disclosure, a pontoon boat is disclosed. The pontoon boat comprises a plurality of longitudinally extending pontoons, a deck supported atop the plurality of pontoons, and a plurality of foils coupled to the plurality of pontoons. The plurality of pontoons includes first and second outer pontoons and a middle pontoon positioned intermediate the first and second outer pontoons. The plurality of foils includes a first foil coupled to the first outer pontoon and a second foil coupled to the middle pontoon. At least a portion of the first foil is positioned vertically below an entirety of the second foil. The first foil extends longitudinally along the first outer pontoon for a first length, and the second foil extends longitudinally along the middle pontoon for a second length. The second length is longer than the first length.

BRIEF DESCRIPTION OF THE DRAWINGS

The above-mentioned and other features and objects of this invention and the manner of obtaining them will become more apparent and the invention itself will be better understood by reference to the following description of embodiments of the present invention taken in conjunction with the accompanying drawings, wherein.

Figure 1:
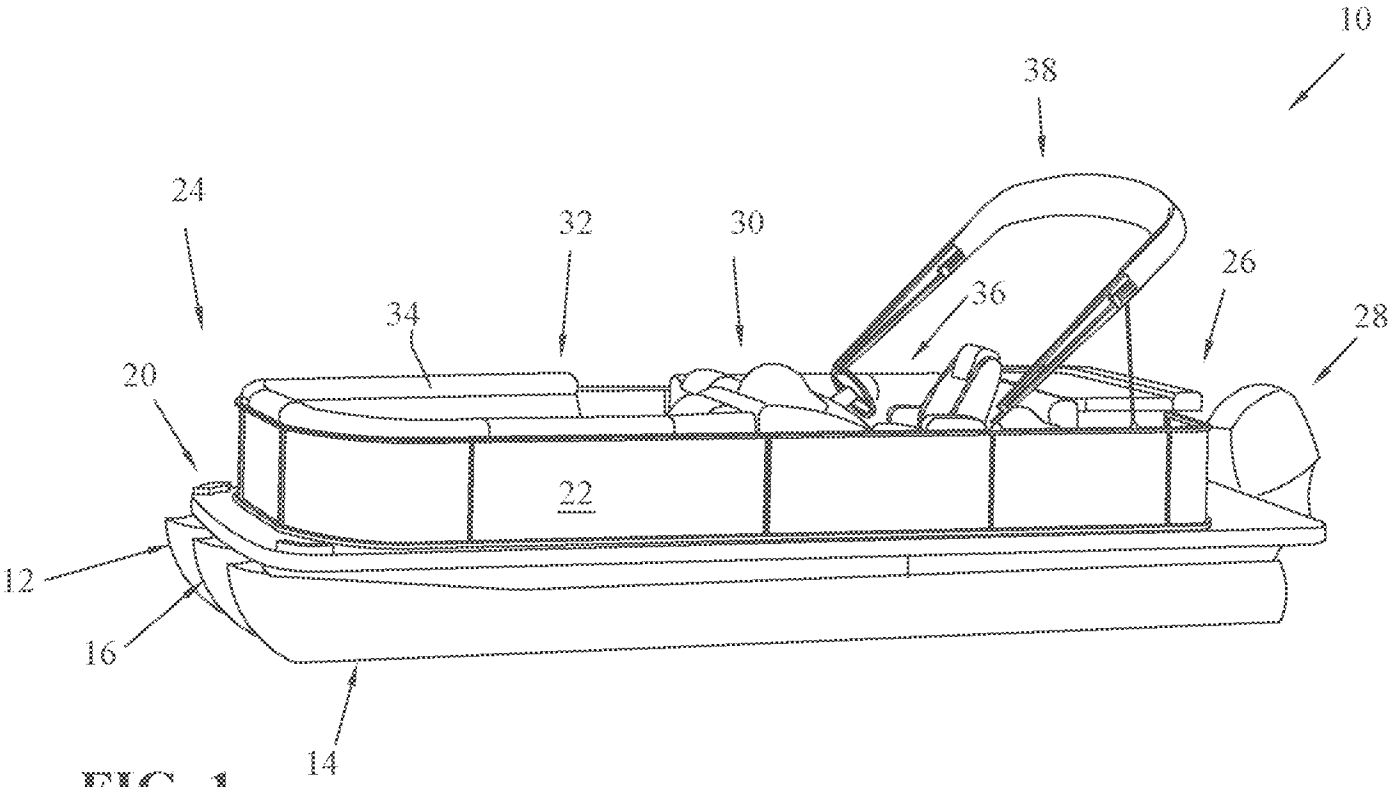
FIG. 1 is a perspective view of one embodiment of a pontoon boat having a deck supported by three pontoons.

Corresponding reference characters indicate corresponding parts throughout the several views. Although the drawings represent embodiments of the present invention, the drawings are not necessarily to scale and certain features may be exaggerated in order to better illustrate and explain the present invention. The exemplification set out herein illustrates embodiments of the invention, and such exemplifications are not to be construed as limiting the scope of the invention in any manner.

DETAILED DESCRIPTION OF THE DRAWINGS

For the purposes of promoting an understanding of the principles of the invention, reference will now be made to the embodiments illustrated in the drawings, which are described below. It will, nevertheless, be understood that no limitation of the scope of the invention is thereby intended. The invention includes any alterations and further modifications in the illustrated devices and described methods and further applications of the principles of the invention, which would normally occur to one skilled in the art to which the invention relates.

Referring now to FIG. 1, one embodiment of a pontoon boat in accordance with the subject invention is shown generally indicated as 10. Pontoon boat 10 includes a plurality of pontoons, illustratively an outer pair of pontoons 12, 14 and a middle pontoon 16. In embodiments, additional pontoons may be provided. Pontoons 12, 14, 16 are longitudinally extending buoyant members upon which pontoon boat 10 floats and rides in a body of water. Pontoon boat 10 also includes a deck 20 mounted above pontoons 12, 14, 16 and extending in a generally horizontal plane. Deck 20 is supported by the plurality of pontoons. Pontoon boat 10 also includes a railing 22 extending around deck 20. In the exemplary embodiment shown, railing 22 encircles an inner portion of deck 20 and extends from approximately a front or bow end 24 of deck 20 to approximately a rear or stern end 26 of deck 20. In embodiments, railing 22 may be spaced rearward of front end 24 of deck 20 to provide a forward deck portion without a railing. In embodiments, railing 22 may be spaced forward of rear end 26 of deck 20 to provide a rearward deck portion without a railing.

Pontoon boat 10 also includes a power source 28, illustratively an outboard engine, operably coupled to pontoon 16 proximate rear end 26 of deck 20. An exemplary outboard engine includes, for example, the 425 horsepower XTO Offshore outboard produced by Yamaha Motor Corporation, U.S.A., 1270. Chastain Road, Kennesaw, GA 30144. In other embodiments, power source 28 may comprise an inboard/outboard drive or a multi-engine configuration.

Deck 20 includes a rearward seating area 30 and a forward seating area 32. Forward seating area 32 includes a plurality of seats 34 for passengers of pontoon boat 10. Similarly, rearward seating area 30 may include a plurality of seats in which occupants may be seated while riding on pontoon boat 10. Rearward seating area 30 also includes an operator area 36 having at least one actuatable operator input for operating power source 28 and pontoon boat 10. Pontoon boat 10 also includes a collapsible canopy 38 pivotally coupled to railing 22. Canopy 38 is pivotable between a stored configuration (shown in FIG. 1) and a deployed configuration in which canopy 38 covers at least a portion of rearward seating area 30 and forward seating area 32. In embodiments, canopy 38 may comprise an upper frame fixedly coupled to railing 22. In other embodiments, canopy 38 may comprise a hard-shell cover or superstructure for deck 20.

Figure 2:
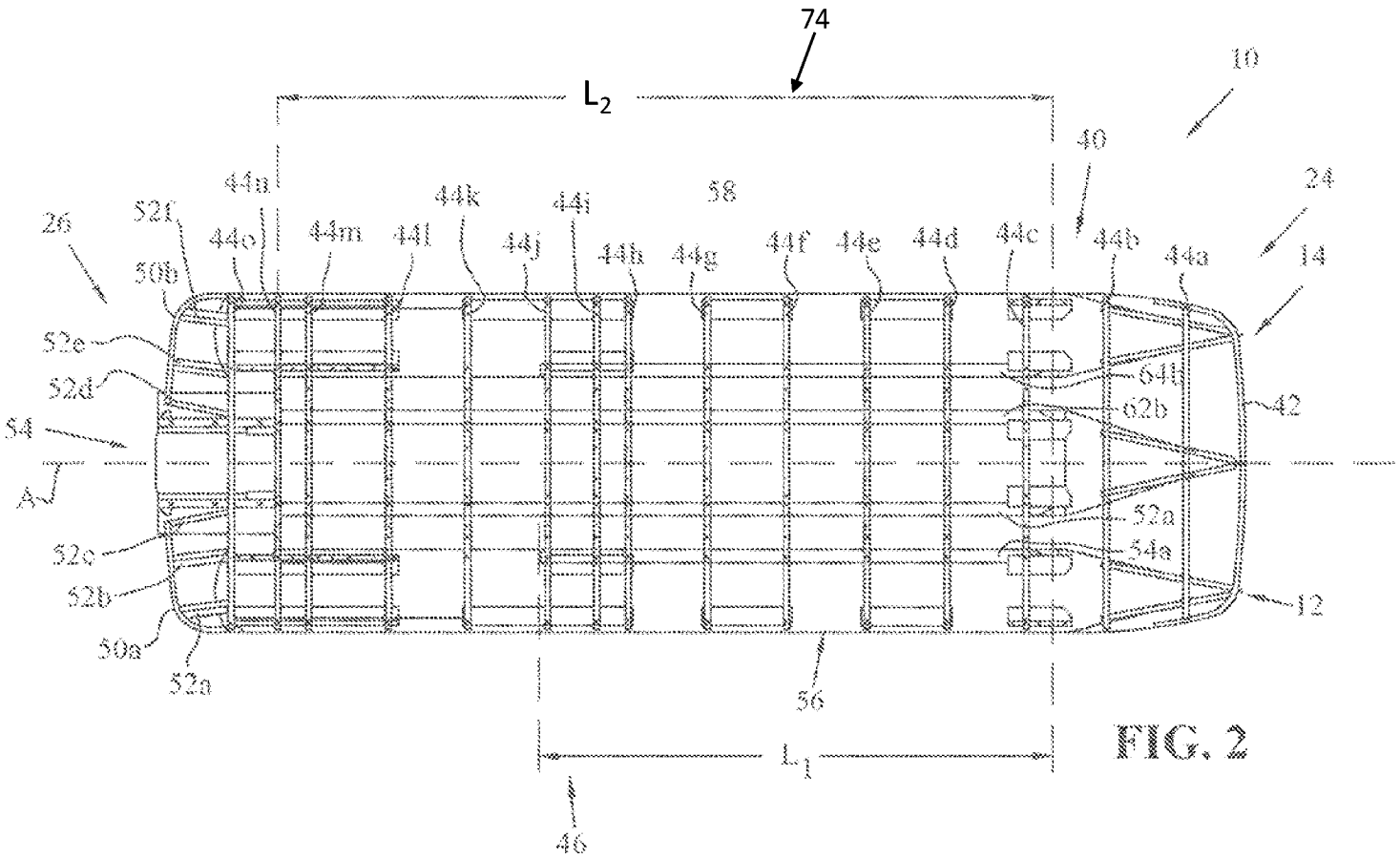
FIG. 2 is a top view of a deck frame supported atop the three pontoons.

Turning now to FIG. 2, deck 20 (see FIG. 1) is supported by a framework 40, which is connected to pontoons 12, 14, 16 using a plurality of brackets. In the embodiment shown, the plurality of brackets support framework 40 above a top surface of pontoons 12, 14, 16. Framework 40 includes a forward perimeter rail 42 positioned at bow end 24 of deck 20 and a plurality of transverse cross members 44, illustratively cross members 44*a-o*, arranged perpendicular to a longitudinal axis A of pontoon boat 10. Cross members 44 extend from a right or starboard side 46 of pontoon boat 10 to a left or port side 48 of pontoon boat 10. In the exemplary embodiment shown, cross members 44 are spaced apart from one another and are distributed along a longitudinal length of deck 20 of pontoon boat 10. It is contemplated, however, that cross members 44 may be grouped and arranged as the design of deck 20 requires. In embodiments, framework 40 may include more or fewer than cross members 44*a-o*.

Framework 40 also includes a split rearward perimeter rail 50, illustratively a starboard side rearward perimeter rail 50*a* and a port side rearward perimeter rail 50*b*, proximate stern end 26 of deck 20 of pontoon boat 10. In the exemplary embodiment shown, rearward perimeter rails 50*a*, 50*b* are positioned longitudinally rearward of an end of pontoons 12, 14. Accordingly, starboard side rearward perimeter rail 50*a* is supported by a plurality of support members 52, illustratively 52*a-c*, coupled to cross member 44*o*, and port side rearward perimeter rail 50*b* is supported by a plurality of support members 52, illustratively, 52*d-f*, coupled to cross member 44*o*. Positioned laterally intermediate rearward perimeter rails 50*a*, 50*b* is a power source support structure 54 coupled to middle pontoon 16 and configured to support power source 28.

Framework 40 also includes a starboard side perimeter rail 56 positioned on starboard side 46 of pontoon boat 10 and extending from the forward perimeter rail 42 to starboard side rearward perimeter rail 50*a*. Framework 40 also includes a port side perimeter rail 58 positioned on port side 48 of pontoon boat 10 and extending from forward perimeter rail 42 to starboard side rearward perimeter rail 50*b*. In the exemplary embodiment shown, deck 20 further includes a platform 60 (see FIG. 3) supported atop framework 40.

Figure 3:
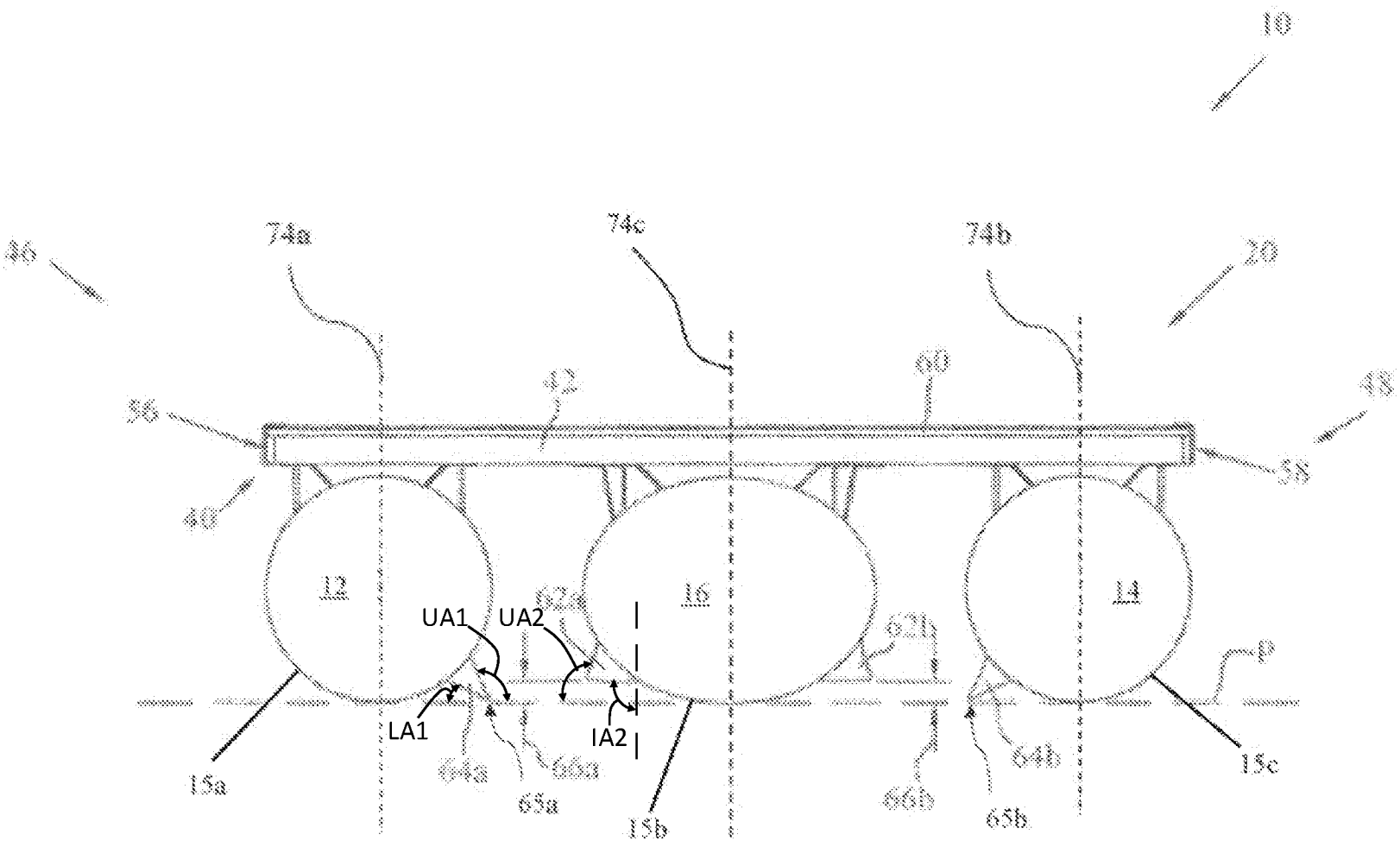
FIG. 3 is a front end view of the deck and deck frame supported atop the three pontoons with the multi-chine configuration of present disclosure.
Figure 4:
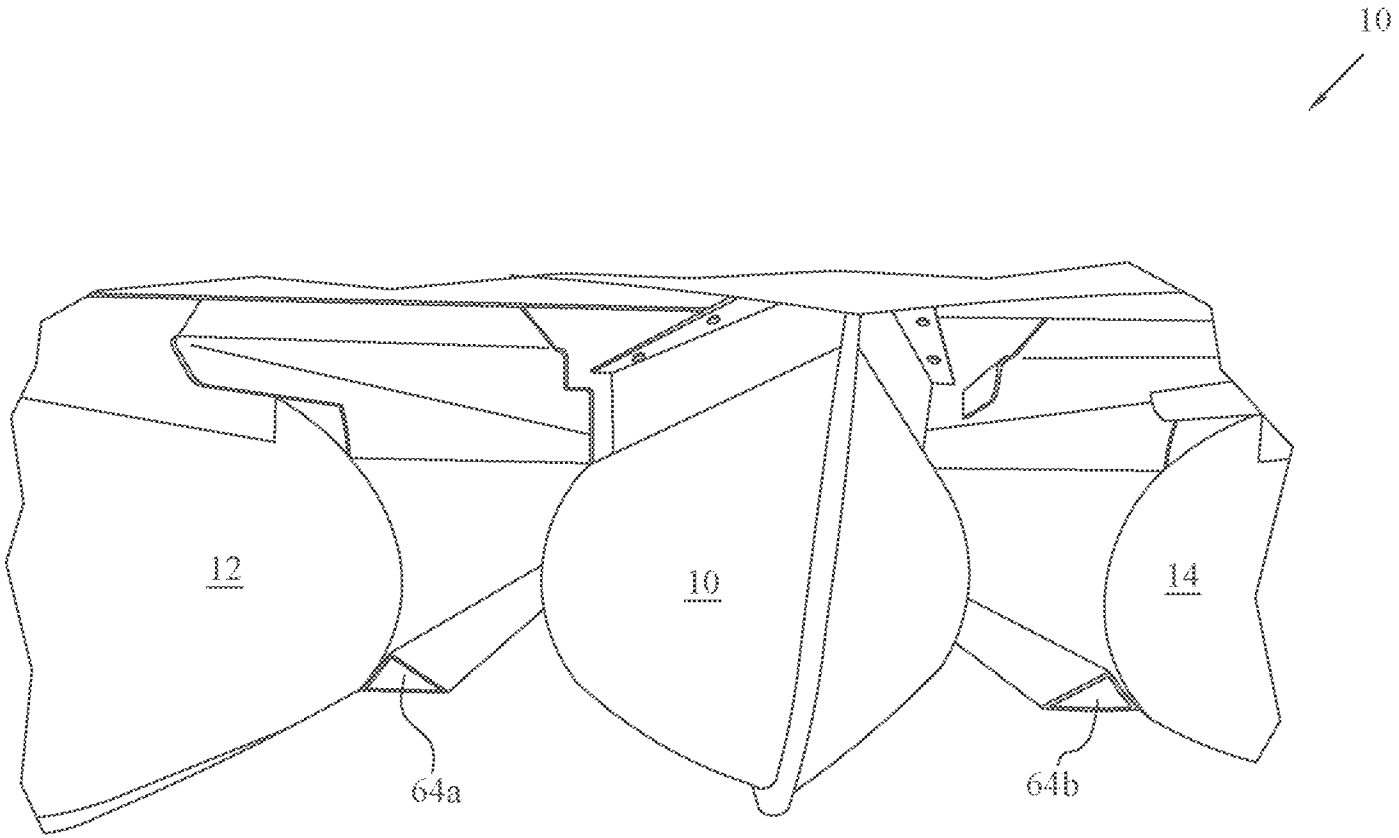
FIG. 4 is a partial, front end perspective view of the multi-chine structure of FIG. 3.
Figure 5:
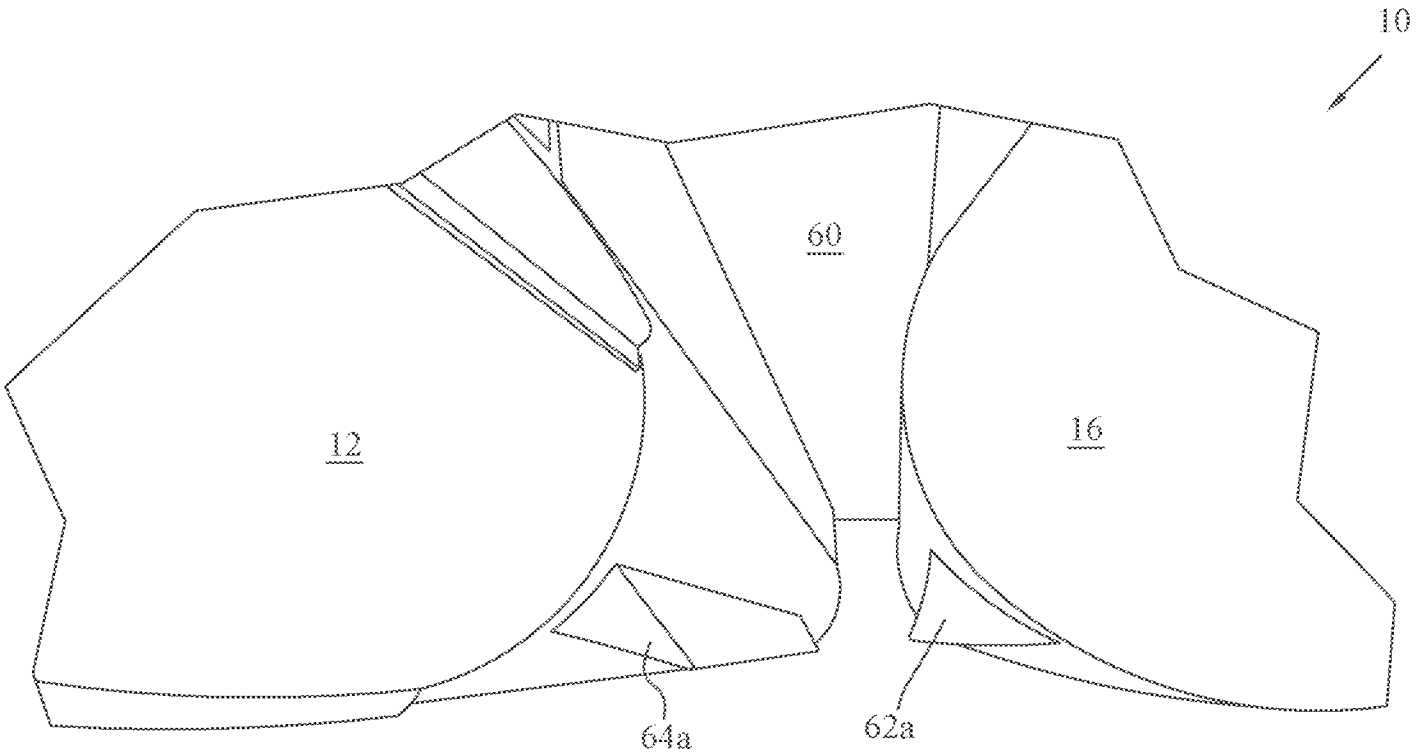
FIG. 5 is a partial, bottom perspective view of the multi-chine structure of FIG. 3.

Turning now to FIGS. 3-5, pontoons 12, 14, 16 are shown in more detail. In the exemplary embodiment shown, middle pontoon 16 is arranged along longitudinal axis A (see FIG. 2) of pontoon boat 10 and outer pontoons 12, 14 and arranged laterally outward of middle pontoon 16. More specifically, outer pontoon 12 is positioned adjacent starboard side 46 of deck 20 of pontoon boat 10 and outer pontoon 14 is positioned adjacent port side 48 of deck 20 of pontoon boat 10. Outer pontoons 12, 14 are illustratively cylindrically shaped pontoons, and middle pontoon 16 is illustratively an elliptically shaped pontoon. More specifically, outer pontoons 12, 14 have a cylindrically shaped transverse cross-section, and middle pontoon 16 has an elliptically shaped transverse cross-section. As shown in FIGS. 1 and 4, pontoons 12, 14, 16 also include a longitudinally curved nose cone proximate bow end 14 of deck 20. In the exemplary embodiment shown, a vertically lowest point of each of the outer surfaces of pontoons 12, 14, 16 are co-planar, as indicated by plane P in FIG. 3. Plane P is tangential to the vertically lowest point of each of the outer surfaces of pontoons 12, 14, 16. In the illustrated embodiment, plane P is horizontal.

Figure 6:
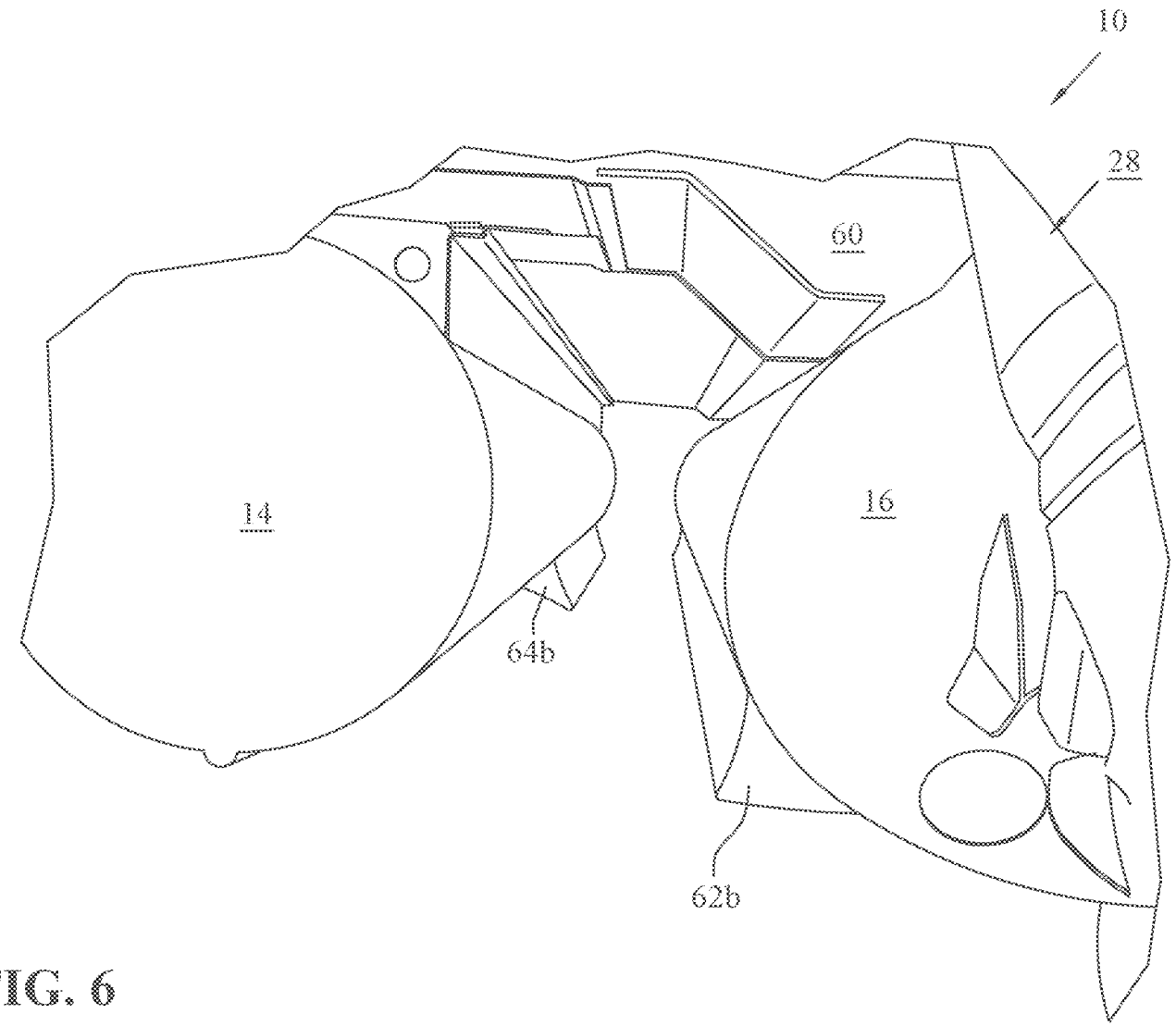
FIG. 6 is a partial, rear end perspective view of the multi-chine structure of FIG. 3.

Pontoon boat 10 illustratively includes a plurality of chines configured to provide pontoon boat 10 with the handling characteristics of a hulled boat. More specifically, middle pontoon 16 includes a plurality of strakes or foils 62, illustratively a starboard foil 62*a* and a port foil 62*b*, coupled to an outer surface 15*b* (envelope 15*b*) of pontoon 16. Foils 62*a*, 62*b* are positioned on outer surface 15*b* of pontoon 16 adjacent the respective one of pontoons 12, 14. More specifically, foil 62*a* is positioned on the outer surface of pontoon 16 adjacent outer pontoon 12, and foil 62*b* is positioned on the outer surface of pontoon 16 adjacent outer pontoon 14. Foils 62 extend laterally outward from the outer surface of pontoon 16 to a distal end point. In the exemplary embodiment shown, foils 62 comprise an upswept chine. Accordingly, foils 62 have a generally triangular cross-section and extend further laterally outward than vertically downward from the outer surface of pontoon 16. Each of foils 62*a* and 62*b* include an upper surface that forms an upper angle UA2 from the horizontal plane P and an inner surface that forms an inner angle IA2 from a vertical plane. It is contemplated, however, that foils 62 may comprise a differently shaped chine than shown. For example, foil 62 may comprise a reverse chine or a stepped chine. As illustrated in FIGS. 4-6, a forward end and a rear end of each of foils 62 are blunt and closed-off. It is contemplated, however, that either the forward end or the rear end of foils 62 may be open or comprise a hydrodynamic shape. In addition, the cross-section of each of foils 62 is generally constant as it extends from the forward end to a rear end. It is contemplated, however, that the cross-section of foils 62 may increase or decrease. For example, the cross-section of foils 62 may decrease such that foils 62 fade into the outer surface of pontoon 16 at either of the forward or rear end.

Each of outer pontoons 12, 14 also include a strake or foil 64, illustratively foils 64*a*, 64*b*, coupled to an outer surface 15*a* (envelope 15*a*) and an outer surface 15*c* (envelope 15*c*) of a respective one of pontoons 12, 14. More specifically, foil 64*a* is positioned on outer surface 15*a* of pontoon 12 adjacent middle pontoon 16. Similarly, foil 64*b* is positioned on outer surface 15*c* of pontoon 14 adjacent middle pontoon 16. Accordingly, foils 64 are positioned on the laterally inward sides of the respective one of pontoons 12, 14 and extend laterally inward to a distal end point. In the illustrated embodiment of FIG. 3, pontoon 12 comprises a center plane 74*a*, pontoon 14 comprises a center plane 74*b*, and pontoon 16 comprises a center plane 74*c*. Foil 64*a* is positioned on the outer surface of pontoon 12 such that an apex 65*a* of the foil 64*a* is on one side of the center plane 74*a*. Similarly, foil 64*b* is positioned on the outer surface of pontoon 14 such that an apex 65*b* of the foil 64*b* is on one side of the center plane 74*b*. Further in the illustrated embodiment of FIG. 3, foil 64*a* is positioned on outer surface 15*a* of pontoon 12 such that the entirety of the foil 64*a* is on one side of the center plane 74*a*. Similarly, foil 64*b* is positioned on outer surface 15*c* of pontoon 14 such that the entirety of the foil 64*b* is on one side of the center plane 74*b*. In the exemplary embodiment shown, foils 64 comprise a negative foil, or an extreme reverse chine oriented laterally inward. Accordingly, foils 64 have a generally triangular cross-section and extend further vertically downward than laterally outward from the outer surface of the respective one of outer pontoons 12, 14. Each of foils 64*a* and 64*b* include an upper surface that forms an upper angle UM from the horizontal plane P and a lower surface that forms a lower angle LM from the horizontal plane P. It is contemplated, however, that foils 64 may comprise a differently shaped chine than shown. As illustrated in FIGS. 4-6, a forward end and a rear end of each of foils 64 are blunt and closed-off. It is contemplated, however, that either the forward end or the rear end of foils 64 may be open or comprise an hydrodynamic shape. In addition, the cross-section of each of foils 64 is generally constant as it extends from the forward end to a rear end. It is contemplated, however, that the cross-section of foils 64 may increase or decrease. For example, the cross-section of foils 64 may decrease such that foils 64 fade into the outer surface of the respective one of pontoons 12, 14 at either of the forward or rear end.

Referring specifically to FIG. 3, the lowest vertical extent or point of foils 64 of the respective one of outer pontoons 12, 14 are positioned vertically lower than an entirety of foils 62 of middle pontoon 16. More specifically, the distal end point of foil 64*a*, which is the vertically lowest point of foil 64*a* of outer pontoon 12, is positioned vertically lower than foil 62*a* of middle pontoon 16, as indicated by a gap 66*a* in FIG. 3. Similarly, the distal end point of foil 64*b*, which is the vertically lower point of foil 64*b* of outer pontoon 14, is positioned vertically lower than foil 62*b* of middle pontoon 16, as indicated by a gap 66*b* in FIG. 3. In the embodiment shown, gaps 66*a*, 66*b* are identical and comprise a distance of 2 inches to 3 inches. Illustratively, gaps 66*a*, 66*b* comprise a distance of approximately 2.48 inches. It is contemplated, however, that gaps 66*a*, 66*b* may be different from one another and that gaps 66*a*, 66*b* may comprise a distance greater or smaller than shown so long as the distance is nonzero. Illustratively, the distal end points of foils 64 of outer pontoons 12, 14 are co-planar with plane P, and foils 62 of middle pontoon 16 are spaced apart from and vertically above plane P.

Figure 7:
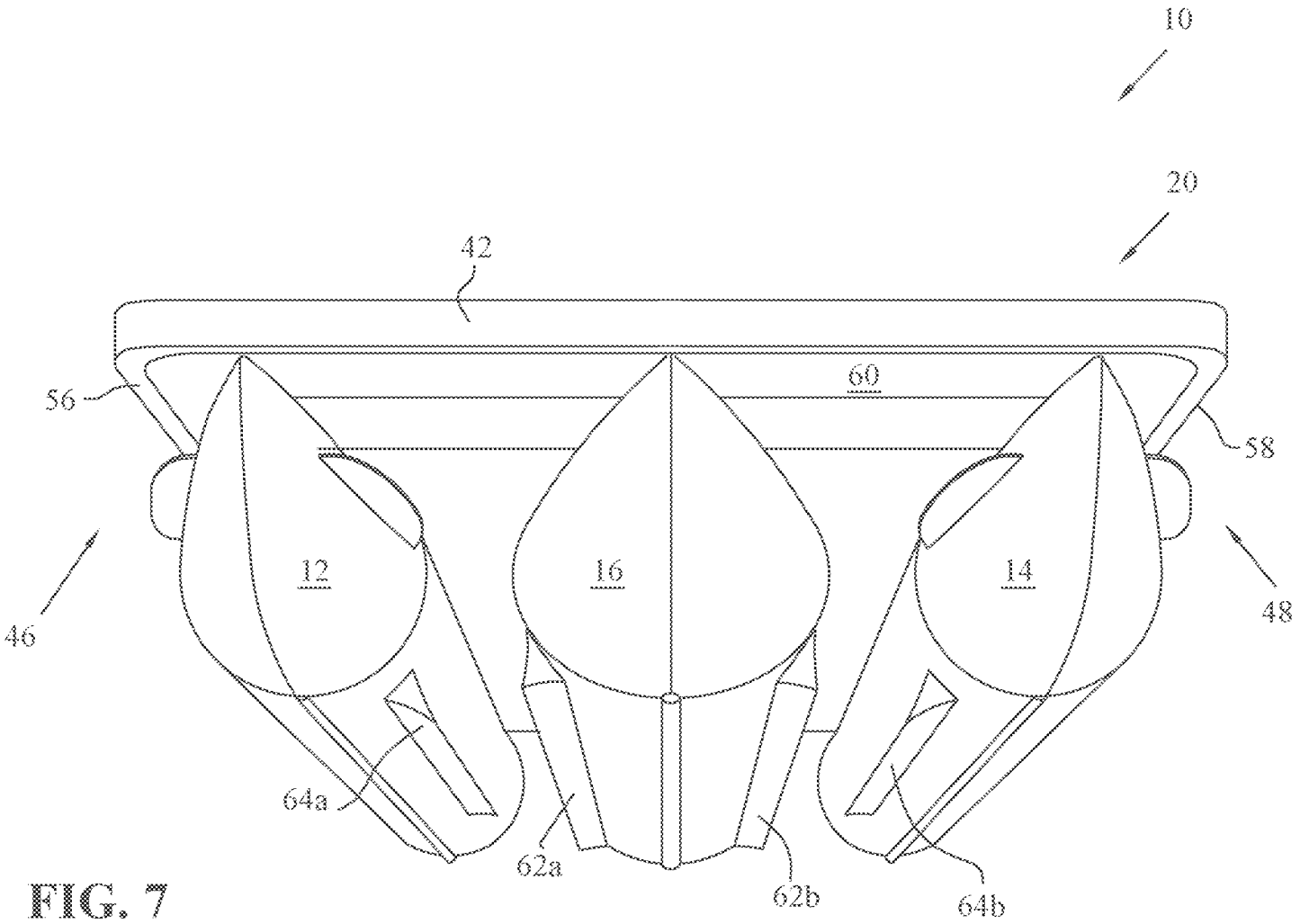
FIG. 7 is a bottom perspective view of the pontoon boat of FIG. 1.

Referring now to FIGS. 2, 6, and 7, foils 64 extend longitudinally along their respective one of outer pontoons 12, 14 for a length $L_1$. Conversely, foils 62 extend longitudinally along middle pontoon 16 for a length $L_2$. In the exemplary embodiment shown, length $L_2$ is longitudinally longer than length $L_1$. Accordingly, foils 62 of middle pontoon 16 extend longitudinally further than foils 64 of outer pontoons 12, 14. Illustratively, length $L_1$ is approximately half of the length of length $L_2$, and length $L_2$ extends from proximate bow end 24 of deck 20 to stern end 26 of deck 20. In the exemplary embodiment shown, the start of foils 62, 62 are set back from bow end 24 of deck 20 as each of pontoons 12, 14, 16 includes a curved nose cone. It is contemplated, however, that lengths $L_1$, $L_2$ may be longer or shorter than shown.

Foils 62, 64 are configured and positioned on the outer surface of the respective one of pontoons 12, 14, 16 to improve the handling characteristics of pontoon boat 10. More specifically, foils 62, 64 are configured to provide handling characteristics (e.g., banking and planning characteristics) similar to a hulled boat. Foils 62, 64 also increase the stability of pontoon boat 10, especially when a heavy or powerful power source 28 is used and passengers seat themselves in forward seating area 32. In addition, foils 62, 64 cooperate to provide a three-point planning surface for pontoon boat 10 during operation thereof. More specifically, foils 64 provide lift for bow end 24 of pontoon boat 10, and foils 62 providing a stabilizing surface for stern end 26 of pontoon boat 10. Accordingly, foils 64 of pontoons 12, 14 in combination with foils 62 of pontoon 16 provide the "three" points of the planning surface for pontoon boat 10. In addition, foils 62, 64 assist with the high-speed performance of pontoon boat 10. For example, foils 64 provide a stabilizing surface which permit pontoon boat 10 to bank into a turn while the configuration of foils 62 slide sideways over the water.

Figure 8:
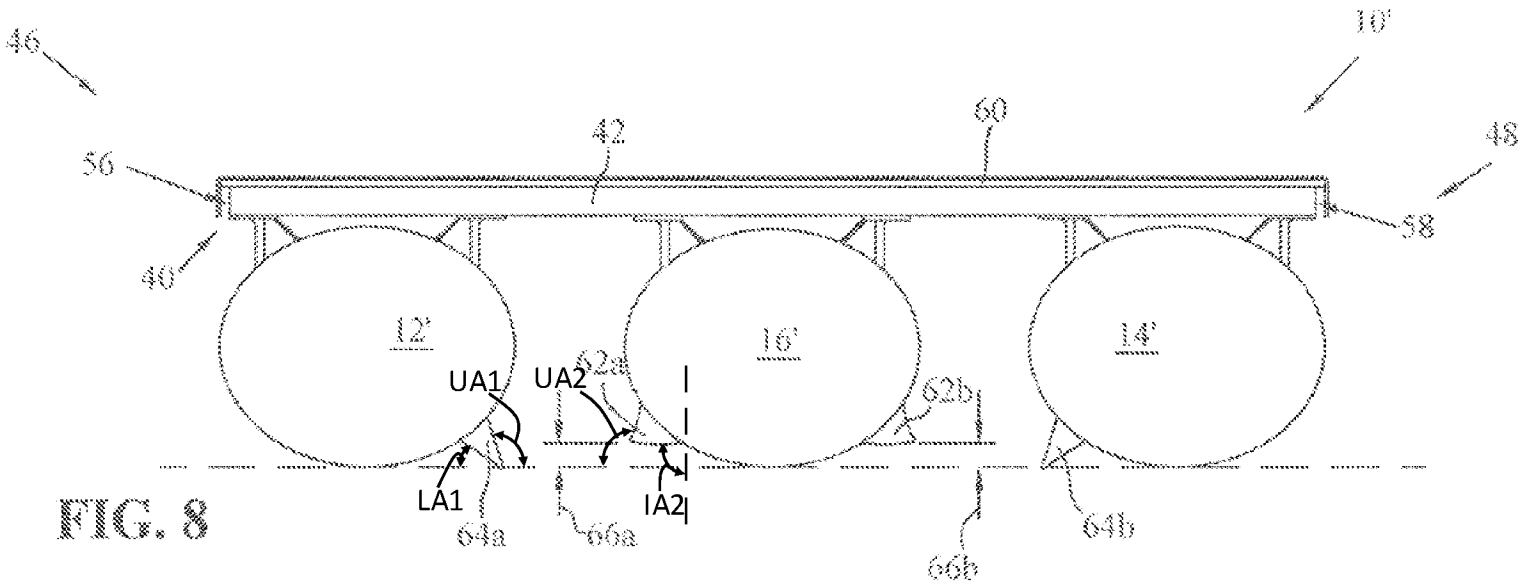
FIG. 8 is a front end view of another embodiment of a pontoon boat having a multi-chine configuration.

Turning now to FIG. 8, another exemplary pontoon boat 10' having a multi-chine configuration is shown. Because pontoon boat 10' is similar to pontoon boat 10, reference characters in pontoon boat 10' correspond to the same or similar reference characters in pontoon boat 10. Illustratively, pontoon boat 10' includes outer pontoons 12', 14' and a middle pontoon 16' positioned laterally intermediate outer pontoons 12', 14'. In the exemplary embodiment shown, each of pontoons 12', 14', 16' comprises an elliptically shaped pontoon. A vertically lowest point of each of the outer surfaces of pontoons 12', 14', 16' are co-planar, as indicated by plane P in FIG. 8. Middle pontoon 16' includes a plurality of foils 62, illustratively foils 62*a*, 62*b*, and each of outer pontoons 12', 14' includes a foil 64, illustratively foils 64*a*, 64*b*. A distal end point of foils 64 of outer pontoons 12', 14' is co-planar with plane P and extends vertically lower than the entirety of foils 62*a*, 62*b* of middle pontoon 16'. As described above in connection with pontoon 10, foils 62 of middle pontoon 16' extend longitudinally further than foils 64 of outer pontoons 12', 14'. As shown in FIG. 8, the upper angle UA2 formed by the upper surface of the foils 62*a* and 62*b* is greater than the upper angle UA1 formed by the upper surface of the foils 64*a* and 64*b*.

Figure 9:
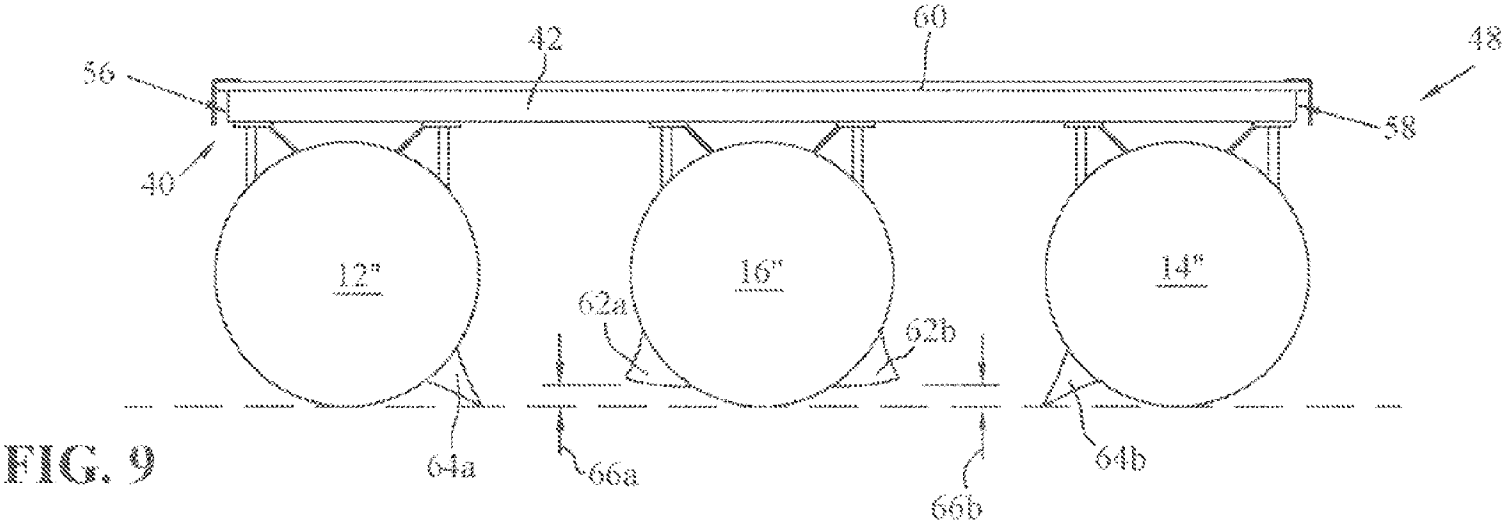
FIG. 9 is a front end view of a further embodiment of a pontoon boat having a multi-chine configuration.

Referring now to FIG. 9, another exemplary pontoon boat 10" having a multi-chine configuration is shown. Because pontoon boat 10" is similar to pontoon boat 10, reference characters in pontoon boat 10" correspond to the same or similar reference characters in pontoon boat 10. Illustratively, pontoon boat 10" includes outer pontoons 12", 14" and a middle pontoon 16" positioned laterally intermediate outer pontoons 12", 14". In the exemplary embodiment shown, each of pontoons 12", 14", 16" comprises a cylindrically shaped pontoon. A vertically lowest point of each of the outer surfaces of pontoons 12", 14", 16" are co-planar, as indicated by plane P in FIG. 9. Middle pontoon 16" includes a plurality of foils 62, illustratively foils 62*a*, 62*b*, and each of outer pontoons 12", 14" includes a foil 64, illustratively foils 64*a*, 64*b*. A distal end point of foils 64 of outer pontoons 12", 14" is co-planar with plane P and extends vertically lower than an entirety of foils 62*a*, 62*b* of middle pontoon 16". As described above in connection with pontoon 10, foils 62 of middle pontoon 16" extend longitudinally further than foils 64 of outer pontoons 12", 14".

Figure 10:
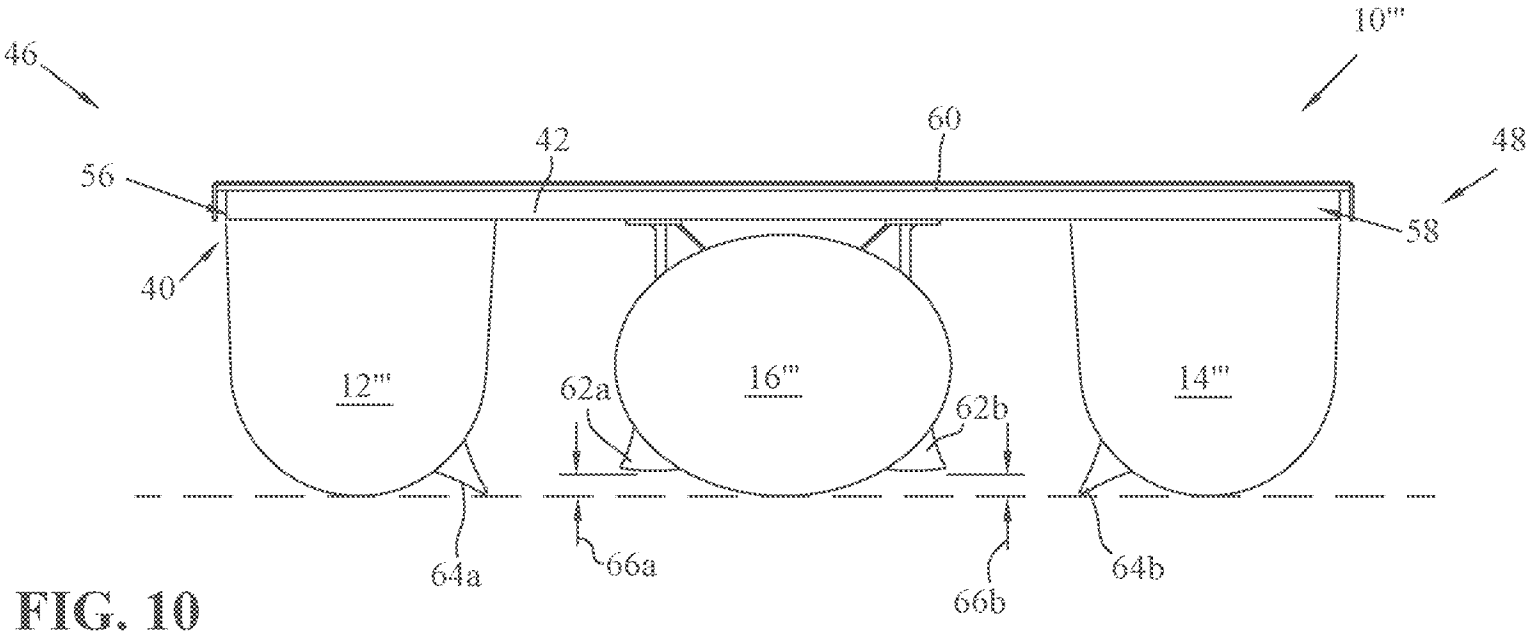
FIG. 10 is a front end view of another embodiment of a pontoon boat having a multi-chine configuration.

Turning now to FIG. 10, another exemplary pontoon boat 10" having a multi-chine configuration is shown. Because pontoon boat 10" is similar to pontoon boat 10, reference characters in pontoon boat 10" correspond to the same or similar reference characters in pontoon boat 10. Illustratively, pontoon boat 10" includes outer pontoons 12", 14" and a middle pontoon 16" positioned laterally intermediate outer pontoons 12", 14". In the exemplary embodiment shown, middle pontoon 16" comprises a cylindrically shaped pontoon and each of outer pontoons 12", 14" comprises a U-shaped hull. It is contemplated that middle pontoon 16" may also comprise a cylindrically shaped pontoon. A vertically lowest point of each of the outer surfaces of pontoons 12", 14", 16" are co-planar, as indicated by plane P in FIG. 10. Middle pontoon 16" includes a plurality of foils 62, illustratively foils 62*a*, 62*b*, and each of outer pontoons 12", 14" includes a foil 64, illustratively foils 64*a*, 64*b*. A distal end point of foils 64 of outer pontoons 12", 14" is co-planar with plane P and extends vertically lower than an entirety of foils 62*a*, 62*b* of middle pontoon 16". As described above in connection with pontoon 10, foils 62 of middle pontoon 16" extend longitudinally further than foils 64 of outer pontoons 12", 14".

While the invention has been taught with specific reference to these embodiments, one skilled in the art will recognize that changes can be made in form and detail without departing from the spirit and scope of the invention. Therefore, the described embodiments are to be considered, therefore, in all respects only as illustrative and not restrictive. As such, the scope of the invention is indicated by the following claims rather than by the description.

In one example, a pontoon boat 10 is provided. Pontoon boat 10 includes a plurality of pontoons. The plurality of pontoons including a first pontoon 12 having a first vertical center plane 74*a*, a second pontoon 16 having a second vertical center plane 74*c*, and a third pontoon 14 having a third vertical center plane 74*b*. The second pontoon 16 positioned intermediate the first and third pontoons 12, 14. The plurality of pontoons extending longitudinally. Pontoon boat 10 further includes a deck 20 supported atop the plurality of pontoons. Pontoon boat 10 further includes a plurality of foils coupled to the plurality of pontoons. The plurality of foils including a first foil 64*a* extending into a space between the first vertical center plane 74*a* of the first pontoon 12 and the second vertical center plane 74*c* of the second pontoon 16 and a second foil 62*a* extending into the space between the first vertical center plane 74*a* of the first pontoon 12 and the second vertical center plane 74*c* of the second pontoon 16. A distal end of the first foil 64*a* positioned vertically below an entirety of the second foil 62*a* and the distal end of the first foil 64*a* is positioned between the first vertical center plane 74*a* of the first pontoon 12 and the second vertical center plane 74*c* of the second pontoon 16.

In another example, a pontoon boat 10 is provided. Pontoon boat 10 includes plurality of pontoons. The plurality of pontoons including first and second outer pontoons 12 and 14 and a middle pontoon 16 positioned intermediate the first and second outer pontoons 12 and 14. The plurality of pontoons extending longitudinally. Pontoon boat 10 further includes a deck 20 supported atop the plurality of pontoons and a plurality of foils coupled to the plurality of pontoons. The plurality of foils including a first foil 64*a* coupled to a first one of the plurality of pontoons and a second foil 62*a* coupled to a second one of the plurality of pontoons, at least a portion of the first foil 64*a* positioned vertically below an entirety of the second foil 62*a*. The first foil 64*a* extends longitudinally along the first one of the plurality of pontoons (illustratively pontoon 12) for a first length and the second foil 62*a* extends longitudinally along the second one of the plurality of pontoons (illustratively pontoon 16) for a second length, the first length is approximately half the second length. The first outer pontoon 12 has a first vertical center plane 74*a* and the second outer pontoon 14 has a second vertical center plane 74*b*. The first foil 64*a* and the second foil 62*a* both being positioned completely between the first vertical center plane 74*a* of the first outer pontoon 12 and the second vertical center plane 74*b* of the second outer plane 14.

In another example, a pontoon boat 10 is provided. Pontoon boat 10 includes a plurality of pontoons, the plurality of pontoons including an outer starboard pontoon 12 having a first envelope 15*a*, an outer port pontoon 14 having a second envelope 15*c*, and an intermediate pontoon 16 having a third envelope 15*b* and being positioned intermediate the outer starboard pontoon 12 and the outer port pontoon 14. A first vertically lowest point of a first one of the first envelope 15*a* of the outer starboard pontoon 12, the second envelope 15*c* of the outer port pontoon 14, and the third envelope 15*b* of the intermediate pontoon 16 is horizontally aligned with a second vertically lowest point of a second one of the first envelope 15*a* of the outer starboard pontoon 12, the second envelope 15*c* of the outer port pontoon 14, and the third envelope 15*b* of the intermediate pontoon 16 at a first horizontal plane (P). The plurality of pontoons extending longitudinally. Pontoon boat 10 further includes a deck 20 supported atop the plurality of pontoons and a plurality of foils coupled to the plurality of pontoons. A distal end (one of apex 65*a* and apex 65*b*) of a first foil (one of foil 64*a* and foil 64*b*) of the plurality of foils is aligned with the first horizontal plane (P). The first foil extending from a third one of the first envelope 15*a* of the outer starboard pontoon 12, the second envelope 15*c* of the outer port pontoon 14, and the third envelope 15*b* of the intermediate pontoon 16, the third one being different from the first one and the second one.

The invention claimed is:

1. A pontoon boat, comprising:

a plurality of longitudinally extending pontoons including a first pontoon, a second pontoon and a third pontoon, the second pontoon positioned intermediate the first and third pontoons;

a deck supported atop the plurality of pontoons; and a plurality of foils coupled to the plurality of pontoons, the plurality of foils including a first foil extending from the first pontoon toward the second pontoon, and a second foil extending from the second pontoon toward the first pontoon;

wherein a distal end of the first foil is positioned vertically below an entirety of the second foil.

2. The pontoon boat of claim 1, wherein a lowest vertical extent of the first pontoon and a lowest vertical extent of the second pontoon are horizontally aligned.

3. The pontoon boat of claim 2, wherein the distal end of the first foil is horizontally aligned with the lowest vertical extent of the first pontoon and the lowest vertical extent of the second pontoon.

4. The pontoon boat of claim 1, wherein the distal end of the first foil is horizontally aligned with a lowest vertical extent of the first pontoon.

5. The pontoon boat of claim 1, wherein the distal end of the first foil is horizontally aligned with a lowest vertical extent of the second pontoon.

6. The pontoon boat of claim 1, wherein a majority of the plurality of pontoons are cylindrically shaped.

7. The pontoon boat of claim 1, wherein a minority of the plurality of pontoons is non-cylindrically shaped.

8. The pontoon boat of claim 1, wherein at least one of the plurality of pontoons is U-shaped.

9. A pontoon boat, comprising:

a plurality of longitudinally extending pontoons including first and second outer pontoons and a middle pontoon positioned intermediate the first and second outer pontoons;

a deck supported atop the plurality of pontoons; and a plurality of foils coupled to the plurality of pontoons, the plurality of foils including a first foil and a second foil, at least a portion of the first foil positioned vertically below an entirety of the second foil, wherein the first foil extends longitudinally along the first outer pontoon for a first length and the second foil extends longitudinally along the middle pontoon for a second length, the first length is approximately half the second length.

10. The pontoon boat of claim 9, wherein the first outer pontoon has a first vertical center plane and the second outer pontoon has a second vertical center plane, the first foil and the second foil both being positioned completely between the first vertical center plane of the first outer pontoon and the second vertical center plane of the second outer plane.

* * * * *